US006197249B1

(12) United States Patent
Väänänen et al.

(10) Patent No.: US 6,197,249 B1
(45) Date of Patent: Mar. 6, 2001

(54) APPARATUS FOR CONDUCTING GAS THROUGH MATERIAL TO BE SINTERED

(75) Inventors: Eero Väänänen; Lauri Mustikka, both of Tornio (FI)

(73) Assignee: Outokumpu Technology Oy, Espoo (FI)

( * ) Notice: Subject to any disclaimer, the term of this patent is extended or adjusted under 35 U.S.C. 154(b) by 0 days.

(21) Appl. No.: 09/331,284

(22) PCT Filed: Dec. 22, 1997

(86) PCT No.: PCT/FI97/00828

§ 371 Date: Aug. 23, 1999

§ 102(e) Date: Aug. 23, 1999

(87) PCT Pub. No.: WO98/29703

PCT Pub. Date: Jul. 9, 1998

(30) Foreign Application Priority Data

Dec. 30, 1996 (FI) ..... 965253

(51) Int. Cl.[7] ..... C21D 11/00
(52) U.S. Cl. ..... 266/87; 266/178
(58) Field of Search ..... 266/251, 168, 266/178, 87; 432/58; 75/444

(56) References Cited

U.S. PATENT DOCUMENTS 3,259,483 * 7/1966 Austin ..... 75/444
4,316,718 * 2/1982 Drugge ..... 432/58

FOREIGN PATENT DOCUMENTS

1216683 * 12/1970 (GB) .

* cited by examiner

*Primary Examiner*—Scott Kastler
(74) *Attorney, Agent, or Firm*—Morgan & Finnegan LLP

(57) ABSTRACT

The invention relates to an apparatus for conducting gas through material (1) to be sintered, which material is set in an essentially continuous motion, particularly when gas is used for sintering the material; said apparatus comprises a flow guide (7) for conducting gas essentially near to the material (1) to be sintered, and a gas collecting member (10) for collecting the gas that has been made to penetrate the material to be sintered. According to the invention, in the gas flow guide (7) the gas inlet (8) is located centrally with respect to the material (1) to be sintered, and the gas outlet (9) extends essentially over the whole material to be sintered in the transversal direction, when observed in the proceeding direction of said material; and the gas collecting member (10) is composed of funnel elements (11), which are installed essentially at the gas flow apertures (5) provided in the member for conveying the material to be sintered.

15 Claims, 2 Drawing Sheets

APPARATUS FOR CONDUCTING GAS THROUGH MATERIAL TO BE SINTERED

The invention relates to an apparatus for conducting gas through material to be sintered, which material is set in an essentially continuous motion, especially when said gas is used for sintering said material.

Several smelting processes require that the material to be fed into smelting is not too finely divided. Therefore a finely ground material such as a concentrate must first be pelletized and thereafter sintered in order to improve the strength of the pellets. The sintering can be carried out for instance in a conveyor-type furnace where hot gas is blown in the pellet bed in order to sinter the wet pellets. In that case, the gas penetrates only the surface layer of the bed, and the sintering of the bed remains poor. In conveyor-type sintering, there can also be used a belt that is perforated in the lengthwise direction as is described in the SE patent publication 8,704,329. Said publication applies a metal belt which is arranged in between the drawing drum and the folding drum, in the same manner as a conveyor belt. The belt is also provided with several longitudinal perforations that are spaced at given intervals from each other. When using the belt described in the SE publication 8,704,329 for sintering pellets, the pellet bed is fed to a slowly proceeding belt, first to the drying zone, then to the preheating and sintering zone and further to the cooling zone. In these zones, the pellet bed is treated with gas that penetrates the belt owing to the belt perforations. Now the pellet sintering takes place in an even fashion, if changes do not occur for instance in the belt temperature.

Generally the funnels used for controlling the gas flow in a belt sintering furnace are uniform chambers covering the whole zone, and the only way for regulating the process is to manually adjust the speed of rotation according to the temperature of the belt or of the chamber. The temperatures are measured by means of thermoelements that slowly react to the changes in the temperature. Moreover, the thermoelements only measure the temperature of gases penetrating the perforations, and not the temperature of for instance the sintering belt. In the transversal direction, the sintering belt is formed of several perforated areas through which the gases proceed, and therefore the overheating of a single area already leads to a reduction in the gas blowing. If the temperature in this overheated area is remarkably higher than in the rest of the areas, the sintering of the pellets in other areas is very poor, which makes the sintering product extremely non-homogeneous.

When gas flows in a belt sintering furnace are controlled by means of uniform chambers covering the whole zone, and when one temperature on the sintering belt surpasses a so-called alarm cooling temperature, the whole sintering process must be stopped by turning off the gas blowers and burners in the preheating and sintering zones, as well as the blowers in the cooling zones. The speed of the sintering belt cannot be essentially changed, wherefore this type of alarm cooling results, depending on its duration, in a large amount of essentially non-sintered pellets.

The object of the present invention is to eliminate some drawbacks of the prior art and to achieve an improved apparatus which is more reliable in operation for conducting gas through material to be sintered, in which apparatus the gas flow is directed so that the temperature of the member that conveys the material to be sintered can be evened out in the transversal direction of said member. The essential novel features of the invention are apparent from the appended claims.

According to the invention, in order to control a gas flow passing through the material to be sintered, which is set in an essentially continuous motion, the gas is conducted, prior to the material to be sintered, from the gas duct to a control member, so that the gas inlet of the control member is placed centrally with respect to the material to be sintered. The gas inlet also is arranged so that when gas is discharged from the gas duct to the control member, the flow direction is essentially perpendicular to the material to be sintered. The control member extends in its cross-sectional area in the gas flow direction, so that at the gas outlet, the control member extends, with respect to the proceeding direction of the material to be sintered, transversally over the sintering belt serving as the conveying member of the material to be sintered. Now the gas essentially gets into contact with the whole material to be sintered. The form of the control member also is advantageous owing to the fireproof lining. In addition, at the weakest points in the fireproof lining, there can, if necessary, be installed cooling pipes for improving the strength.

According to the invention, the gas collecting member that receives the gases that have passed through the material to be sintered is divided into several parts, so that the collecting member advantageously contains, at least in the transversal direction of the sintering belt, a number of funnel elements corresponding to the number of perforations serving as flow apertures for the penetrating gas. A funnel element is provided with an adjusting member for the gas flowing through the funnel element, and this adjusting member is advantageously controlled by a pyrometer measuring the sintering belt temperature in real time. The temperature measurement can also be carried out by some other similar known method, where it is performed sufficiently rapidly. In order to change the position of the adjusting member according to the temperature, the adjusting member is provided with a pneumatically operating cylinder. Moreover, in the wall of the funnel element, there is attached another gas flow adjusting member operated by a pneumatic cylinder, but this adjusting member is advantageously used only in a so-called emergency cooling. In that case the adjusting member attached in the funnel element wall is opened, and external cooling gas is conducted into the funnel element in order to cool the sintering belt. The adjusting members provided in the funnel element can also be operated electrically or hydraulically without essentially deteriorating the invention.

According to the invention, the temperature-controlled adjusting members connected to the funnel elements operate on the basis of the temperature, so that when the temperature is low, i.e within the range 160–200° C., the adjusting member is completely open, and respectively, when the temperature is too high, i.e. within the range 260–300° C., the adjusting member is closed, thus preventing the flowing of too hot gases and the excessive heating of the sintering belt in the funnel element in question. Because the required temperatures depend for example on the materials to be sintered, the operation of the adjusting member can also be regulated so that a specific low and high temperature range is chosen for each material.

When employing the apparatus according to the invention, the gases passing through the sintering belt can be distributed essentially evenly throughout the whole width of the pellet bed to be sintered. If the temperature at some point of the sintering belt rises, the respective adjusting member controlling this temperature begins to close, thus reducing the gas flow passing through said funnel element. If the temperature rises further and surpasses the so-called emergency cooling temperature, being for instance 30° C. higher than the temperature where the temperature-controlled adjusting member already was closed, the adjusting member provided in the funnel element wall is opened.

By means of the apparatus according to the invention, the flowing of hot gases through material to be sintered can be advantageously controlled, so that the gas flow is distributed essentially evenly throughout the whole width of the sintering belt. At the same time, the apparatus according to the invention essentially reduces the need for emergency cooling caused by an excessive heating of the sintering belt, and thus protects the sintering belt from resulting damage. Consequently the sintering process can now be run essentially without interruptions and disturbances, and as a result, the quality of the pellets to be sintered is improved, the obtained sintering product as such becomes more homogeneous, and the capacity of the sintering furnace grows.

BRIEF DESCRIPTION OF THE DRAWINGS

The invention is described in more detail with reference to the appended drawings, where.

Figure 1:
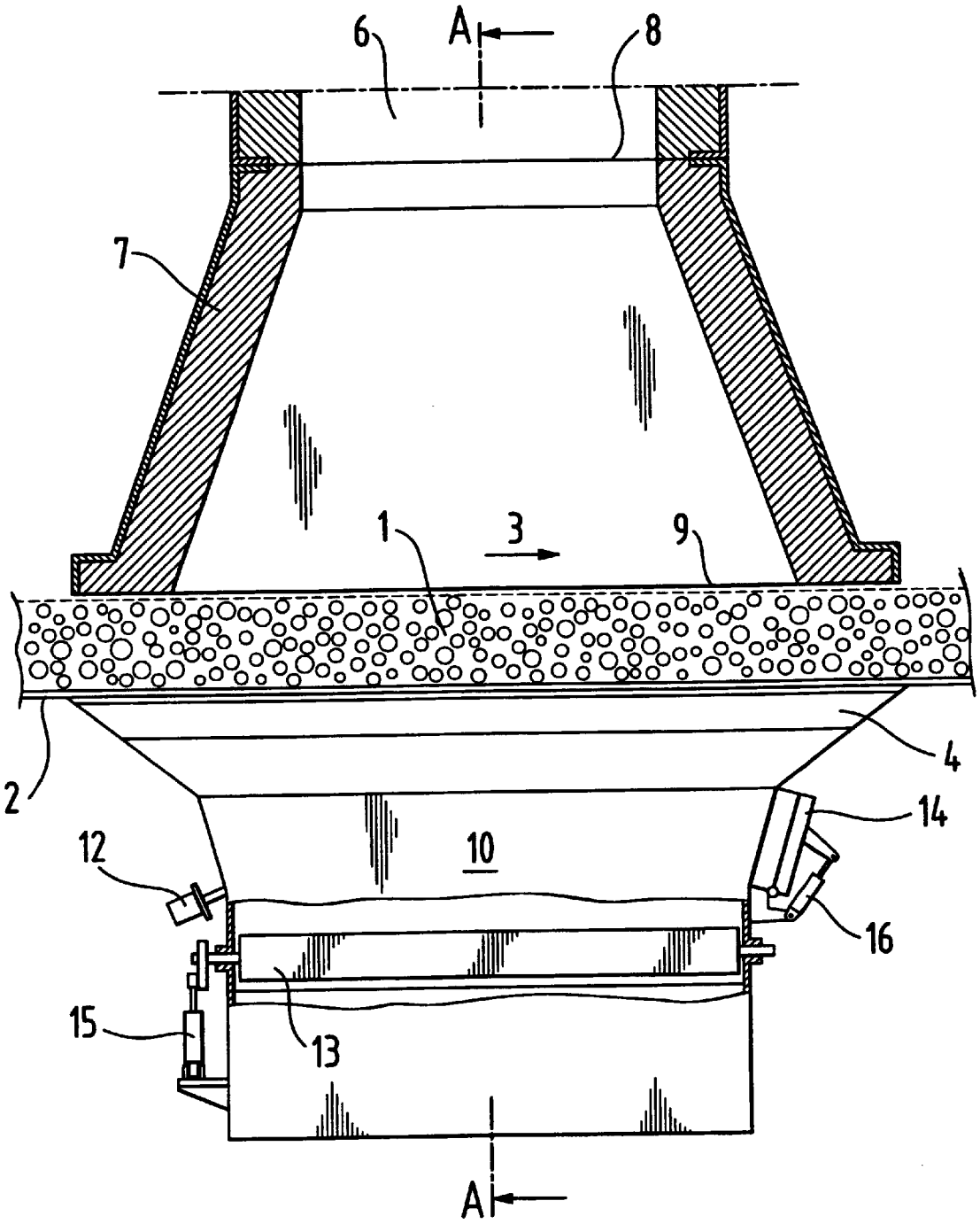
FIG. 1 is a side-view illustration of a preferred embodiment of the invention.
Figure 2:
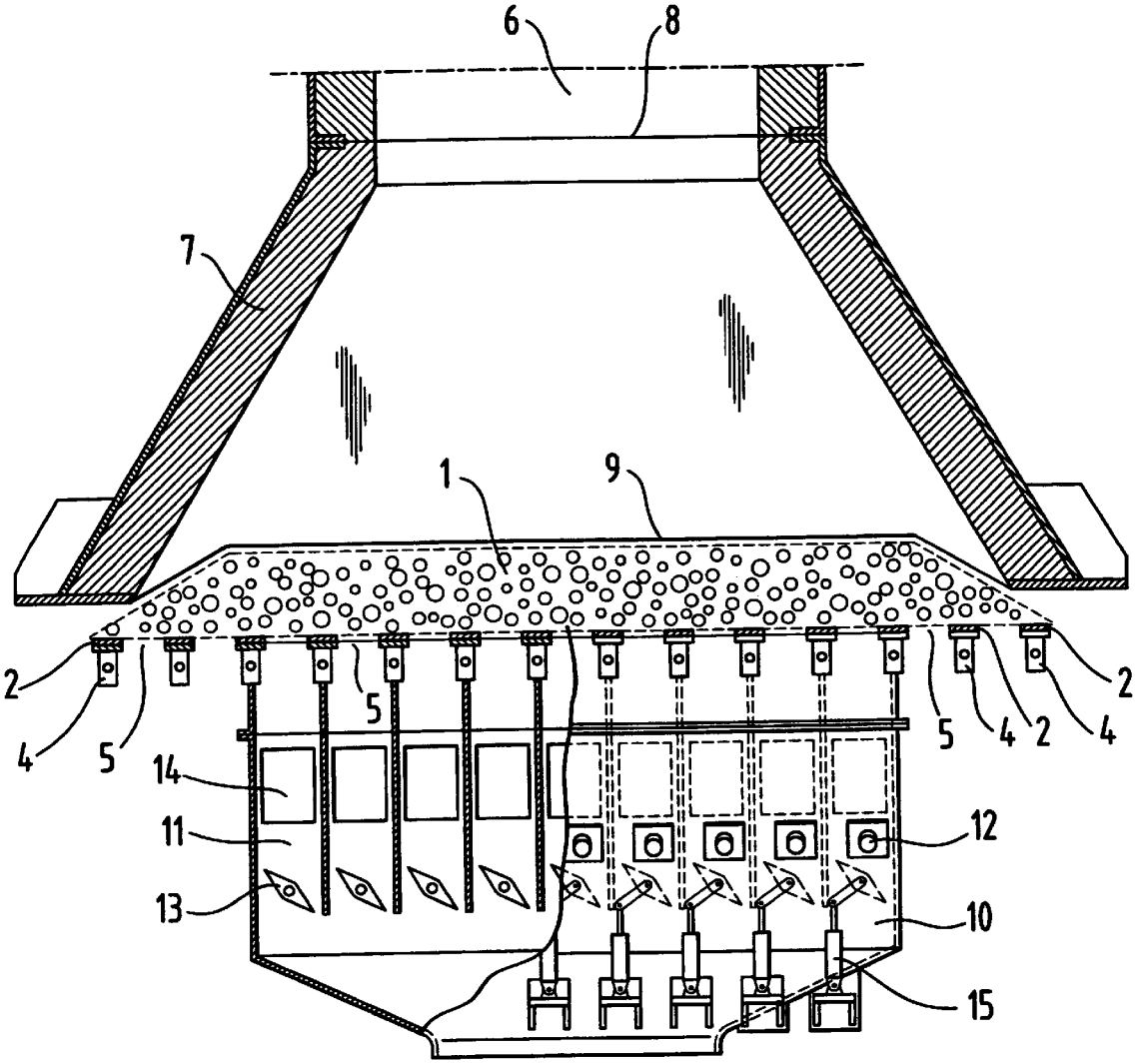
FIG. 2 shows the embodiment of FIG. 1 from the direction A—A.

According to FIGS. 1 and 2, the pellet bed 1 to be sintered is placed on a sintering belt 2, and it moves, along with the sintering belt 2, to the direction 3. The sintering belt 2 is supported by supporting structures 4 in between the perforations 5 provided in the sintering belt. In order to conduct gases from the duct 6 to the pellet bed 1, above the sintering belt 2 there is arranged a flow guide 7, which in cross-section expands in the gas flow direction. The gas duct 6 is essentially centrally connected to the flow guide 7 via the inlet 8 of the flow guide, so that the gas that flows from the duct 6 to the flow guide 7 flows in an essentially vertical direction. In relation to the gas flow direction, the flow guide 7 has an expanding cross-sectional area, so that near the surface of the pellet bed 1, the flow guide 7 extends essentially over the whole sintering belt 2 in the transversal direction, with respect to the moving direction of the belt. Thus the gas passing through the outlet 9 of the flow guide 7 is distributed also throughout the whole width of the sintering belt 2, and thus to the whole of the pellet bed 1.

Underneath the sintering belt 2, at essentially the same point as the flow guide 7, there is installed a collecting member 10 for the gases passing through the pellet bed 1, and this collecting member 10 is essentially composed of a number of funnel elements 11 placed at the perforations 5 serving as flow apertures for the gas penetrating the sintering belt. To the funnel elements 11, there is connected a pyrometer 12 that essentially continuously measures the temperature of the sintering belt 2. In addition, the bottom parts of the funnel elements 11 are provided with an adjusting member 13, which is operated by a pneumatic cylinder 15 narrowly located. Moreover, in the wall of the funnel elements 11 there is installed an adjusting member 14, the operation whereof is controlled by a pneumatic cylinder 16.

The adjusting member 13 provided in the bottom part of the funnel element 11 is used for preventing the flowing of gas, either completely or partly, through the pellet bed 1, if the temperature of the sintering belt 2 measured by the pyrometer 12 surpasses a predetermined temperature value. Now the adjusting member 13 is in closed position, and gas cannot flow through the respective funnel element 11. Thus the influence of gases in the temperature of the sintering belt 2 also decreases, as the gases flow through the rest of the funnel elements 11. If the temperature of the sintering belt 2 essentially surpasses the predetermined temperature value in spite of the closing of the adjusting member 13, there is applied so-called emergency cooling, which means that the adjusting member 14 attached to the wall of the funnel element 11 is opened, so that cooling gas enters from outside the funnel element 11 to cool off the sintering belt 2.

What is claimed is:

1. An apparatus for conducting gas through material to be sintered, said material being set in an essentially continuous motion on a sintering belt having perforations spaced at preselected intervals from each other through which the gas passes, said apparatus comprising a flow guide for conducting the gas essentially near the material to be sintered and a gas collecting member for collecting the gas that has been made to penetrate the material to be sintered, wherein the gas flow guide includes a gas inlet that is located centrally with respect to the material to be sintered, and a gas outlet that extends, in relation to the proceeding direction of the material to be sintered, transversally over essentially the whole range of the material to be sintered, the gas inlet introducing the gas into the flow guide in a flow direction that is essentially perpendicular to the material to be sintered, and the gas collecting member being situated underneath the sintering belt and composed of funnel elements, which are placed essentially at the perforations serving as gas flow apertures, each funnel element being connected to a temperature measuring member that essentially continually measures the temperature of the sintering belt, each funnel element being provided with a temperature controlled adjusting member that is responsive to the temperature measuring member for permitting or preventing flow of gas, partially or completely, through the sintering belt when the temperature of the sintering belt is at first and second preselected temperatures.

2. The apparatus of claim 1, wherein each temperature controlled adjusting member permits flow of gas through the sintering belt into a respective funnel element when the temperature of the sintering belt is at said first preselected temperature, the first preselected temperature being the desired temperature of sintering.

3. The apparatus of claim 2 wherein the first preselected temperature is between 160° C. and 200° C.

4. The apparatus of claim 1, wherein each temperature controlled adjusting member prevents the flow of gas through the sintering belt into a respective funnel element when the temperature of the sintering belt is at said second preselected temperature, the second preselted temperature being above the first preselected temperature.

5. The apparatus of claim 4, wherein the second preselected temperature is between 260° C. and 300° C.

6. The apparatus according to claim 1 wherein the cross-sectional area of the flow guide expands in the gas flow direction, so that at the gas outlet, the flow guide extends, with respect to the proceeding direction of the material to be sintered, transversally essentially over the whole of the material to be sintered.

7. The apparatus of claim 1, wherein the temperature controlled adjusting member is operated pneumatically.

8. The apparatus of claim 1, wherein the temperature controlled adjusting member is operated hydraulically.

9. The apparatus of claim 1, wherein the temperature controlled adjusting member is operated electrically.

10. The apparatus of claim 1, wherein each funnel element of the gas collecting member is provided with a temperature cooling member for conducting cooling gas to the funnel element when the temperature of the sintering belt measured by the temperature measuring element in the funnel element essentially surpasses a third preselected temperature which is higher than said second preselected temperature.

11. The apparatus of claim 10, where said third preselected temperature is 30° C. higher than said second preselected temperature.

12. The apparatus of claim 10, wherein the temperature cooling member is operated pneumatically.

13. The apparatus of claim 10, wherein the temperature cooling member is operated hydraulically.

14. The apparatus of claim 10, wherein the temperature cooling member is operated electrically.

15. The apparatus of claim 1, wherein the number of the funnel elements in the gas collecting member is at least equal to the number of the rows of flow apertures located in the lengthwise direction of the sintering belt.

* * * * *